US011571042B2

(12) United States Patent
Lankford et al.

(10) Patent No.: US 11,571,042 B2
(45) Date of Patent: Feb. 7, 2023

(54) FOOTWEAR WITH WATERPROOF SEAMS

(71) Applicant: TBL Licensing LLC, Stratham, NH (US)

(72) Inventors: Pete Lankford, Newmarket, NH (US); Keith Bodner, Norton, MA (US)

(73) Assignee: TBL Licensing LLC, Stratham, NH (US)

( * ) Notice: Subject to any disclaimer, the term of this patent is extended or adjusted under 35 U.S.C. 154(b) by 134 days.

(21) Appl. No.: 17/097,760

(22) Filed: Nov. 13, 2020

(65) Prior Publication Data

US 2021/0145124 A1 May 20, 2021

Related U.S. Application Data

(60) Provisional application No. 62/935,876, filed on Nov. 15, 2019.

(51) Int. Cl.
*A43B 23/02* (2006.01)
*A43B 23/04* (2006.01)

(52) U.S. Cl.
CPC ..... *A43B 23/0255* (2013.01); *A43B 23/025* (2013.01); *A43B 23/0295* (2013.01); *A43B 23/04* (2013.01)

(58) Field of Classification Search
CPC ..... A43B 23/025; A43B 23/0255; A43B 23/0295
See application file for complete search history.

(56) References Cited

U.S. PATENT DOCUMENTS

| | | | | |
|---|---|---|---|---|
| 1,578,345 | A | 3/1926 | Nelson | |
| 1,983,408 | A * | 12/1934 | Shea | A43B 23/0295 36/55 |
| 2,100,943 | A | 11/1937 | Alessandro | |
| 2,109,884 | A | 3/1938 | David | |
| 7,356,946 | B2 * | 4/2008 | Hannon | B29C 66/135 12/146 C |
| 8,677,539 | B2 * | 3/2014 | Morlacchi | A43B 23/06 36/19 R |
| 2004/0049942 | A1 * | 3/2004 | Chen | A43B 7/085 36/55 |

FOREIGN PATENT DOCUMENTS

| | | | | |
|---|---|---|---|---|
| DE | 202009002479 U1 * | 6/2009 | | A43B 7/12 |

OTHER PUBLICATIONS

Extended European Search Report for Application No. 20207544.6, dated Mar. 23, 2021, 3 pages.

* cited by examiner

*Primary Examiner* — Ted Kavanaugh
(74) *Attorney, Agent, or Firm* — Lerner, David, Littenberg, Krumholz & Mentlik, LLP

(57) ABSTRACT

An article of footwear includes an upper having a quarter having a lower edge having a first slit defined therein and a vamp having an upper edge having a second slit defined therein. The quarter and the vamp are joined along a seam extending along the lower edge of the quarter and the upper edge of the vamp with the first slit and the second slit cooperating with one another. At least a portion of the lower edge of the quarter is adhesively sealed to an inner surface of the vamp.

12 Claims, 4 Drawing Sheets

FOOTWEAR WITH WATERPROOF SEAMS

CROSS-REFERENCE TO RELATED APPLICATIONS

This application claims the benefit of the filing date of U.S. Provisional Patent Application No. 62/935,876, filed Nov. 15, 2019, the disclosure of which is hereby incorporated herein by reference.

FIELD OF THE INVENTION

The present invention relates generally to article of footwear and, more particularly, to footwear such as work boots and shoes.

BACKGROUND OF THE INVENTION

Leather uppers typically fail to protect the wearer from water, causing the wearer's foot to become wet when the footwear is exposed to water, such as when it is raining or when walking through puddles. Wet feet can be extremely uncomfortable for the wearer, especially over long periods of time. This can lead to skin irritation, fungal infections, and the like. Conventionally, one solution has been to include a waterproof bootie within the footwear to protect the feet from water, even if water manages to get inside the footwear.

BRIEF SUMMARY OF THE INVENTION

In one example, an article of footwear includes an upper having a quarter including a lower edge having a first slit defined therein and a vamp including an upper edge having a second slit defined therein. The quarter and the vamp are joined along a first seam extending along the lower edge of the quarter and the upper edge of the vamp with the first slit and the second slit cooperating with one another. At least a portion of the lower edge of the quarter is adhesively sealed to an inner surface of the vamp.

In one example, at least a portion of the upper edge of the vamp is adhesively sealed to an inner surface of quarter.

In one example, a continuous stitch line extends along the first seam.

In an embodiment, the first seam includes a transition area. On a forefoot side of the transition area, the upper edge of the vamp overlays the lower edge of the quarter. On a midfoot side of the transition area, the lower edge of the quarter overlays the upper edge of the vamp.

In an embodiment, at least one row of stitching runs continuously from a forefoot side of the transition area to a midfoot side of eh transition area.

In an example, the lower edge of the quarter includes a first slit and the upper edge of the vamp includes a second slit. The first slit and the second slit cooperatively define a transition area in the first seam.

In an example, a tongue is attached to the vamp along a second seam and to the quarter along a third seam. In an exemplary embodiment, the tongue is cemented to the vamp.

In an example, a height of a section of the upper edge overlaying the lower edge ranges from 6 millimeters to 7 millimeters. In an embodiment, a length of a section of the upper edge overlaying the lower edge ranges from 17 millimeters to 22 millimeters.

DETAILED DESCRIPTION

An exemplary embodiment of an article of footwear will now be described with reference to the figures.

Figure 1:
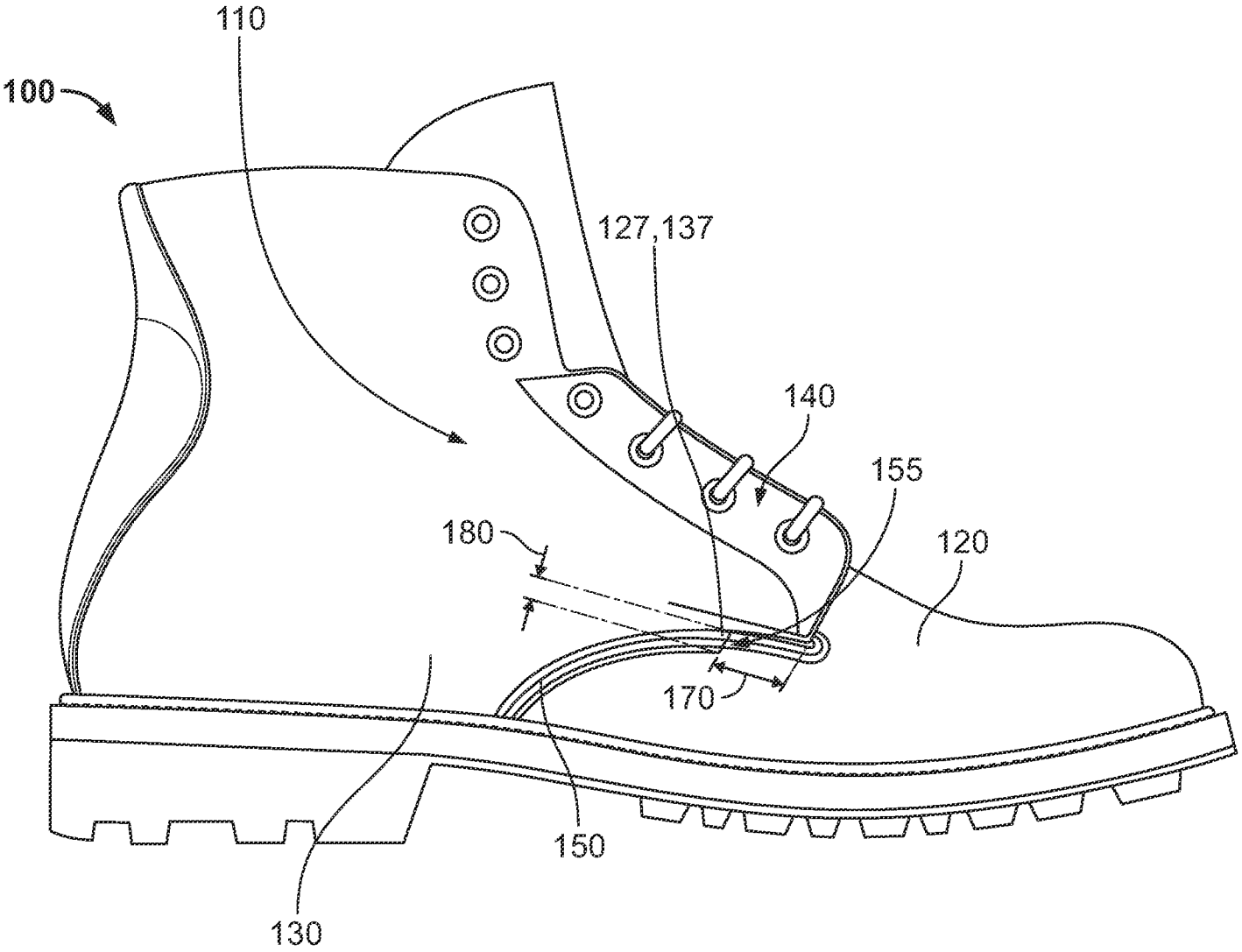
FIG. 1 shows a side view of a boot according to an embodiment of the invention.

A side view of an article of footwear 100, such as a boot, is shown in FIG. 1. While depicted as a boot such as a work boot, the article of footwear 100 may be configured as another type or style of boot or other form of footwear. As depicted, the boot 100 includes an upper 110 defining a cavity adapted to receive a wearer's foot. The upper 110 is flexible, meaning the upper easily bends to allow the wearer's ankle to move freely while secured within the boot. The upper 110 may include one or more distinct regions and/or layers containing different materials. For instance, one of the regions may be a breathable material, meaning that the material preferably includes holes or porous material such as a mesh to allow airflow between the cavity of the boot 100 containing the wearer's foot and the environment outside the boot 100. Another region or regions may include a protective and/or supportive material such as leather, waterproof leather, synthetic, non-porous fabric or other known materials adapted for footwear uppers, such as suede.

Alternatively, the upper 110 of the boot 100 may be made of a plurality of layers of material which are adhered or otherwise attached to each other. The upper 110 may have, for example, a waterproof outer layer with a puncture proof inner layer. The various layers may partially or completely overlap each other. The layers may be attached to each other using nylon stitching or other known stitching commonly used in the footwear arts. These layers may provide the boot 100 with various characteristics which may prove useful to the wearer in different situations. For example, a wearer that commonly works outdoors may require a waterproof boot, while a wearer that commonly works with sharp objects may require a puncture proof boot.

Still referring to FIG. 1, the upper 110 includes a vamp 120 and a quarter 130 with an eye row 140, among other parts. The vamp 120 and the quarter 130 are stitched together via a stitching 150, defining a seam. The stitching 150 includes a scissor-stitching or transition area 155 in the vicinity of the base of the eye row 140. In the forefoot side of the transition area 155, the vamp 120 overlays the quarter 130. On the midfoot side of the transition 155, on the other hand, the quarter 130 overlays the vamp 120. One or more rows of stitches 150 run continuously from the forefoot side of the transition area 155 to the midfoot side of the transition area 155. While the illustrated embodiment includes three rows of stitches 150, it will be understood that other embodiments may include more than or less than three rows of stitching. An advantage of a continuous stitching and multiple rows of stitching is that the movement of the seam during wear may be limited. Still further, when combined with a seam seal cement, entry of water through the seam may be prevented, thereby rendering the seam waterproof.

Figure 2:
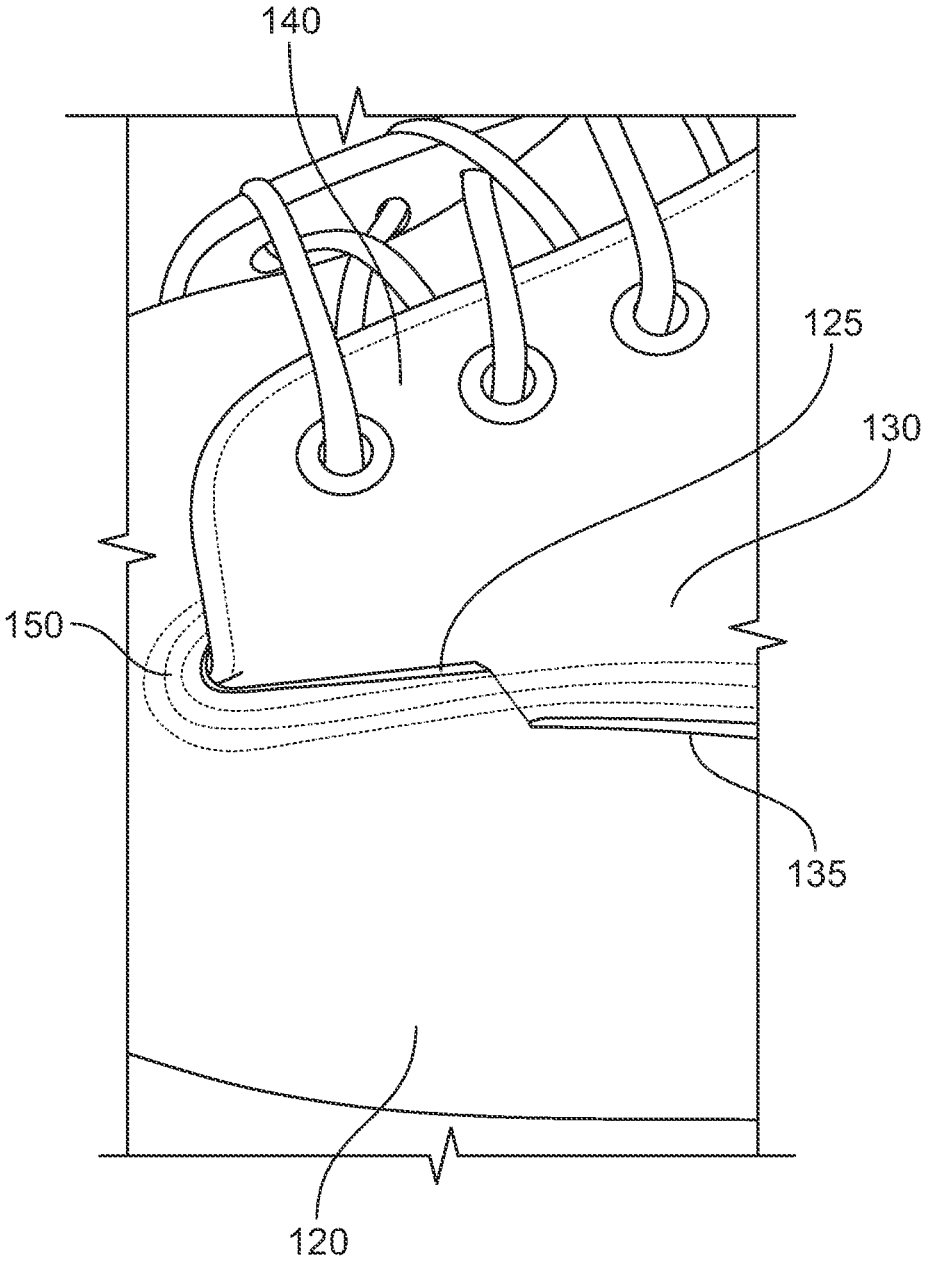
FIG. 2 shows a detailed side view of a scissor-stitching area of a boot according to an embodiment of the invention.

Referring now also to FIG. 2, the vamp 120 includes an upper edge 125 and the quarter 130 includes a lower edge 135. The upper edge 125 includes a slit 127 whereas the lower edge 135 includes a slit 137. The slits 127, 137 facilitates the scissor-stitching 155 such that on the forefoot side of the transition area 155, the upper edge 125 of the vamp 120 overlays the lower edge (not shown) of the quarter 130 and on the midfoot side of the transition area 155, the lower edge 135 of the quarter 130 overlays the upper edge (not shown) of the vamp 120. In one implementation, a length 170 of the section of the upper edge 125 overlaying the lower edge 135 of the quarter 130 may range from about 17 millimeters (mm) to about 22 mm. Of course, in other implementations, the length 170 of the section of the upper edge 125 may be less than 17 mm or more than 22 mm. In one implementation, a height 180 of the section of the upper edge 125 overlaying the lower edge 135 of the quarter 130 may range from about 6 mm to about 7 mm. It will be understood that, in other implementations, the height 180 of the section of the upper edge 125 may be less than 6 mm or more than 7 mm. The height 180 of the section of the upper edge 125 may be based on the number of rows of stitching in the stitching 150.

Figure 3:
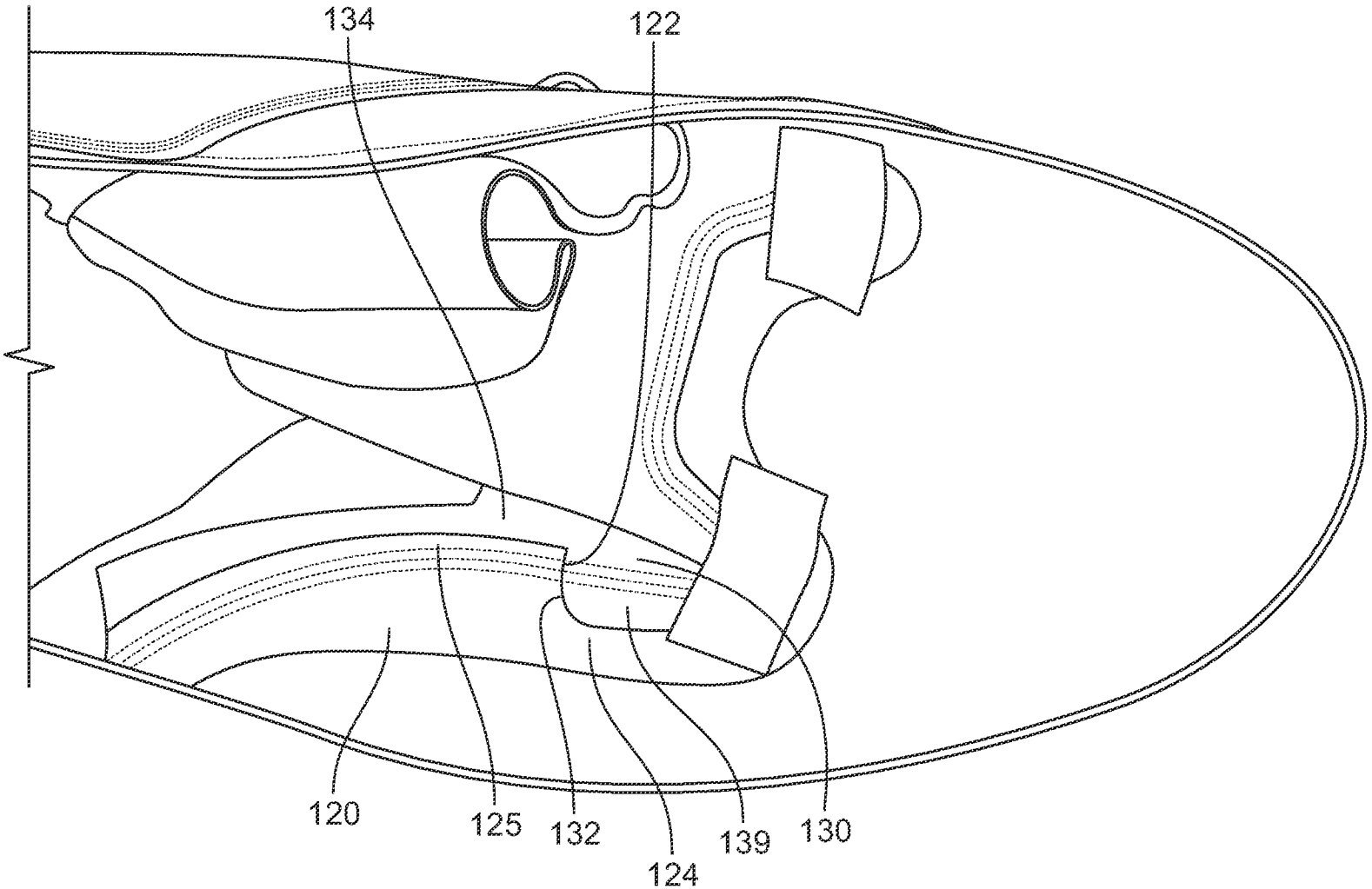
FIG. 3 is an inside view of the scissor stitching of FIG. 1A according to an embodiment of the invention.

Referring now to FIG. 3, the quarter 130 further includes a flange 139 that extends beyond the stiches 150. In one example, the flange 139 may be adhesively sealed to an inner surface 124 of the vamp 120, for example using rubber cement. In one implementation, the flange 139 is stitched and then sealed with a cement that fills gaps between the flange and the vamp 120 as well as within the holes created by the individual stitches of the stiches 150. Likewise, in one implementation, the upper edge 125 of the vamp 120 may be adhesively sealed to an inner side 134 of the quarter 130. In one implementation, the upper edge 125 of the vamp 120 and the inner surface 134 may be cemented together, referred to as a wet fit, and then stitched together. A seam seal cement (not shown) may be applied over the stitched seam, thereby rendering the seam waterproof. Thus, the seam between the vamp 120 and the quarter 130 may be made waterproof via scissor stitching 155, thereby eliminating a need for a separate waterproof bootie.

Figure 4:
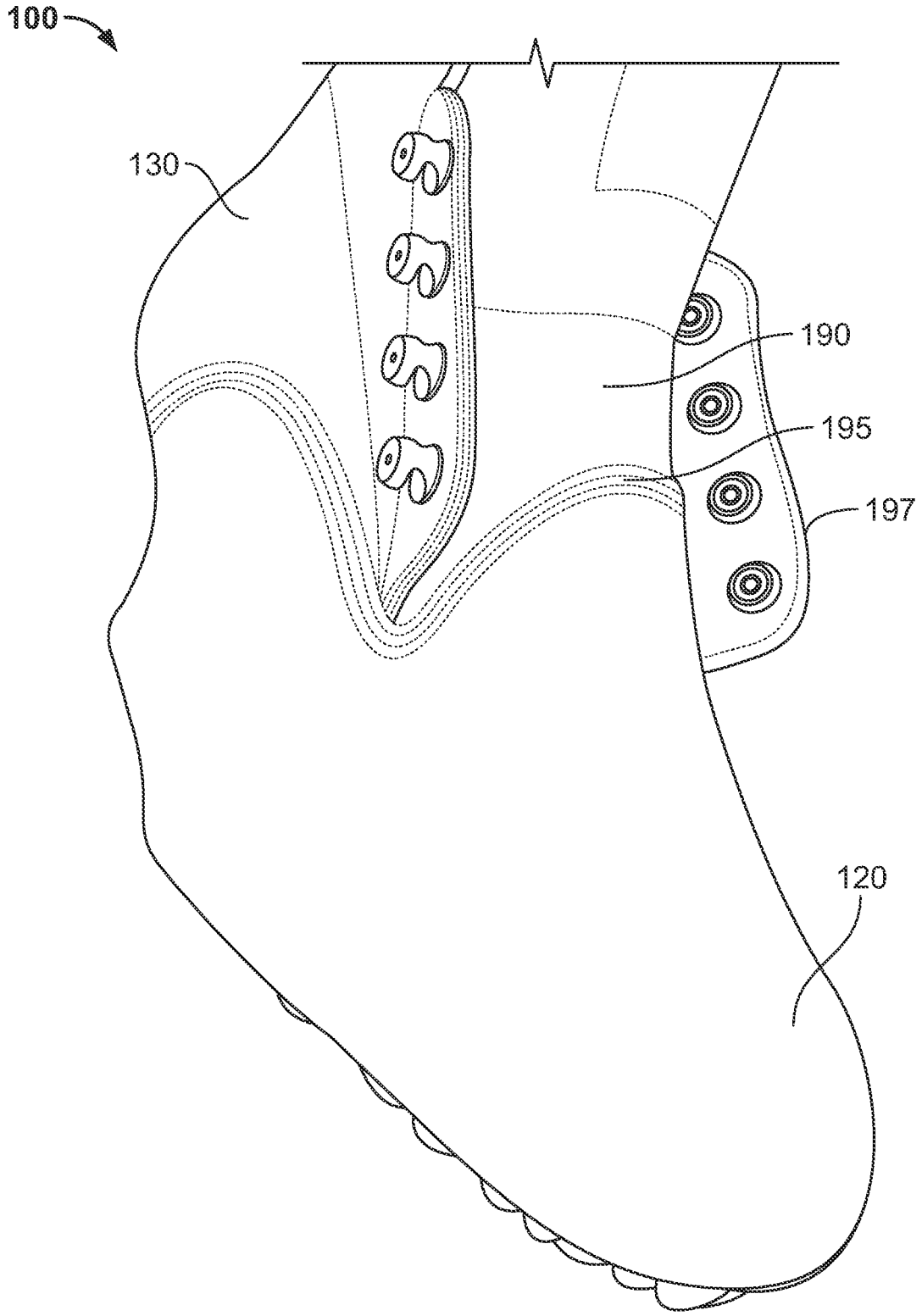
FIG. 4 illustrates a front perspective view of the boot of FIG. 1 according to an embodiment of the invention.

Referring now to FIG. 4, a tongue 190 is attached to the vamp 120 along a seam 195 and to the quarter 130 along a seam 197. In the illustrated embodiment, the stitch line 150 extends along the seam 195. In one implementation, the tongue 190 may be cemented to the vamp 120 and then stitched together. A seam seal cement (not shown) may be applied to the seam on the interior side of the seam 197.

In one example, an article of footwear comprises an upper comprising a quarter including a lower edge having a first slit defined therein; and a vamp including an upper edge having a second slit defined therein, wherein the quarter and the vamp are joined along a seam extending along the lower edge of the quarter and the upper edge of the vamp with the first slit and the second slit cooperating with one another, and wherein at least a portion of the lower edge of the quarter is adhesively sealed to an inner surface of the vamp; and/or At least a portion of the upper edge of the vamp is adhesively sealed to an inner surface of quarter; and/or The article of footwear further comprises a continuous stitch line extending along the seam.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An article of footwear comprising:

an upper comprising a quarter including a lower edge having a first slit defined therein; and a vamp including an upper edge having a second slit defined therein, wherein the quarter and the vamp are joined along a first seam extending along the lower edge of the quarter and the upper edge of the vamp with the first slit and the second slit cooperating with one another, and wherein at least a portion of the lower edge of the quarter is adhesively sealed to an inner surface of the vamp.

2. The article of claim 1, wherein at least a portion of the upper edge of the vamp is adhesively sealed to an inner surface of quarter.

3. The article of claim 1, further comprises a continuous stitch line extending along the first seam.

4. The article of claim 1, further comprising a transition area in the first seam.

5. The article of claim 4, wherein, on a forefoot side of the transition area, the upper edge of the vamp overlays the lower edge of the quarter.

6. The article of claim 4, wherein, on a midfoot side of the transition area, the lower edge of the quarter overlays the upper edge of the vamp.

7. The article of claim 4, further comprising at least one row of stitching running continuously from a forefoot side of the transition area to a midfoot side of the transition area.

8. The article of claim 1, wherein the first slit and the second slit cooperatively define a transition area in the first seam.

9. The article of claim 1, further comprising a tongue attached to the vamp along a second seam and to the quarter along a third seam.

10. The article of claim 9, wherein the tongue is cemented to the vamp.

11. The article of claim 1, wherein a height of a section of the upper edge overlaying the lower edge ranges from 6 millimeters to 7 millimeters.

12. The article of claim 1, wherein a length of a section of the upper edge overlaying the lower edge ranges from 17 millimeters to 22 millimeters.

* * * * *